United States Patent [19]

Thomas

[11] 3,974,543

[45] Aug. 17, 1976

[54] COMBINATION KEY RING AND NOTE HOLDER DEVICE

[76] Inventor: Walter N. Thomas, 8634 S. Indiana, Chicago, Ill. 60619

[22] Filed: Sept. 18, 1975

[21] Appl. No.: 614,364

[52] U.S. Cl. ..... 24/67.11

[51] Int. Cl.[2] ..... B42F 1/02

[58] Field of Search ..... 24/67.11, 3 K, 67.7; 108/43

[56] References Cited

UNITED STATES PATENTS

| | | | |
|---|---|---|---|
| 1,489,244 | 4/1924 | Gnegy | 24/3 K |
| 2,297,312 | 9/1942 | Mieth | 24/3 K |

*Primary Examiner*—Werner H. Schroeder
*Assistant Examiner*—Doris L. Troutman
*Attorney, Agent, or Firm*—Mann, Brown & McWilliams

[57] ABSTRACT

A combination key ring and note holder device comprising a miniature clipboard of indented end configuration having opposed ends indented inwardly of the board, a U type resilient clip member that grips the clipboard and has one of its legs pivoted to a stud adjacent one end of the board, and adjacent the clipboard indentation at that end, to pivotally mount the clip member for swinging movement in the plane of the clipboard for movement between a note clipping position in parallelism with the clipboard, and a release position in which the clip member may be disposed to one side of the clipboard, with the clip member being proportioned to frictionally slide its bight portion into a force fitted interfitting relation with the indentation at the board other end to releasably hold the clip member against shifting movement. Also anchored to the stud is a strap that extends through a key ring and is proportioned to dispose the ring in interfitting relation with the board indentation at its one end. Both legs of the clip member will frictionally receive between same and the clipboard slips of paper or the like that may conveniently bear information the user may wish to carry with him along with his car and/or house keys that are applied to the key ring.

8 Claims, 5 Drawing Figures

COMBINATION KEY RING AND NOTE HOLDER DEVICE

This invention relates to a combination key ring and note holder device and more particularly to a device in the nature of a clipboard that will hold both one's car and/or house keys and slips of paper of the like bearing information the user may wish to carry with him.

It frequently happens that when one goes shopping or runs errands it is desirable to have a list of things to buy and/or stops to make. The list when made is ordinarily lodged in one's pocket or pocketbook, and infrequently will become lost or misplaced, with consequent inconvenience and loss of time.

A principal object of the present invention is to provide a combination key ring and note holder device which permits one to conveniently attach his notes for errands, shopping, etc. to his house and/or car keys, whereby misplacement or loss of the notes is avoided, and the presence of the notes in association with the keys is a reminder that the notes are to be referred to.

Another principal object of the invention is to provide a combination key ring and note holder in the nature of a miniature clipboard that carries the key ring bearing the user's keys, and that is arranged to have notes removably clipped to the clipboard for the user's convenience.

Other objects of the invention are to provide a combination key ring and note holder that conveniently accommodates application thereto and removal therefrom of slips of paper or the like bearing notes, that is attractive and convenient in application and size, and that is economical of manufacture, easy to use, and long lasting in nature.

In accordance with the invention, the combination key ring and note holder device is provided comprising a clipboard of indented end configuration in the form of a planar body having the opposed ends of same indented at the median portions of same, and a stud fixed to the body adjacent one of the clipboard ends, and adjacent the indentation thereof, to which is pivotally secured a note holding clip member having a first leg disposed on one side of the clipboard that is pivoted to the stud, a second leg that is to be received on the other side of the clipboard, and that is free of connection to the stud, and a bight portion integrally joining the clip member legs, with the clip member legs being formed to receive the clipboard there between and resiliently grip same. The clip member leg that is pivotally connected to the stud is proportioned lengthwise thereof, between its pivotal connection and the clip member bight portion, to lodge the clip member bight portion in the indentation of the clipboard at the end opposite that to which the clip member is pivotally connected, for frictional swinging movement to either side of the clipboard, whereby when the clip member bight portion is lodged in the clipboard indentation it cooperates with, the clip member is restrained from pivotal movement, but the clip member bight portion may be freed from the clipboard locking indentation for swinging movement to one side or other of the clipboard to release slips of paper or the like gripped thereby.

The clip member pivoting stud has anchored to same a strap received through a key receiving ring that is proportioned to dispose the ring in interfitting relation with the clipboard indentation end that is adjacent the stud whereby a compact combination holder arrangement is provided.

Other objects, uses and advantages will be obvious or become apparent from a consideration of the following detailed description and the application drawings.

Figure 1:
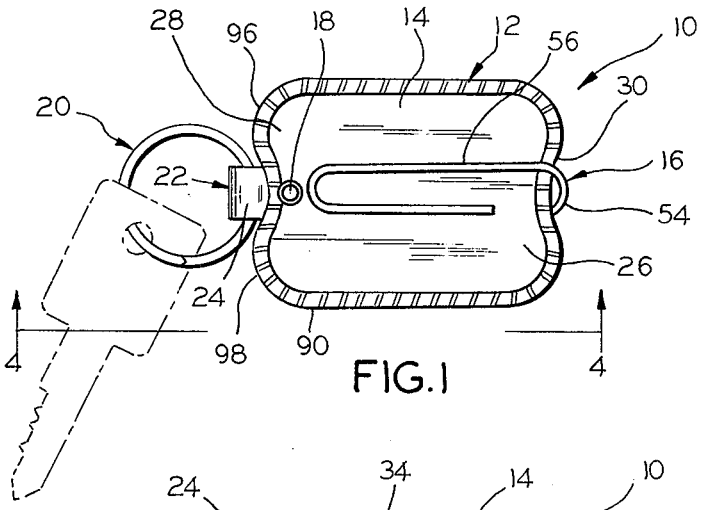
FIG. 1 is a plan view of a preferred embodiment of the invention showing the clip member in clipping relation with the clipboard.

However, it is to be distinctly understood that the drawing illustrations provided are supplied primarily to comply with the requirements of the Patent Laws, and that the invention is susceptible of other embodiments that will be obvious to those skilled in the art, and which are intended to be covered by the appended claims.

Reference numeral 10 generally indicates a preferred embodiment of the invention, which comprises a miniaturized clipboard 12 in the form of a generally quadrilateral and flat or planar body 14 equipped with a clip member 16 that is pivotally connected thereto for swinging movement about pivotal axis 18.

Operably associated with the clipboard 12 is key ring 20 of a conventional type which is anchored to the clipboard 12 by a strap 22 having its ends 24 and 26 made fast to the body 14.

The body 14 is formed to define ends 26 and 28 at either end of the clipboard 12, which are formed to define the respective indentations 30 and 32 in the median portions of the respective ends 26 and 28. The body 14 also defines the opposed side edges 34 and 36 which are generally rectilinear in configuration and extend longitudinally of the body 14.

The body 14 at its end 28, and adjacent the indentation 32, has a suitable fastener device 40 applied thereto to anchor the end 26 of the strap 22 to the body 14 and also to serve as the pivotal mounting for clip member 16. In the form shown, the fastener device 40 is of tubular stud configuration and specifically, is in the form of conventional rivet 42. The strap end 24 in the form shown, is integral with body 14 at its indentation 30 so as to be secured thereto; however, strap end 24 may alternately be anchored to the body 14 by rivet 42.

The clip member 16 is of filamentous construction and comprises a first leg 50 having its end portion 52 looped about the rivet 42 to pivotally connect the clip member 16 to the rivet 42. The leg 50 merges into bight portion 54 that integrally connects the leg 50 with the second clip member leg 56 that is disposed on the other side of the body 14. Leg 56 is generally of U configuration having its end portion 58 disposed to project away from the rivet 42, and forming clip arm 59 that bears against body 14 for substantially the full length.

Figure 2:
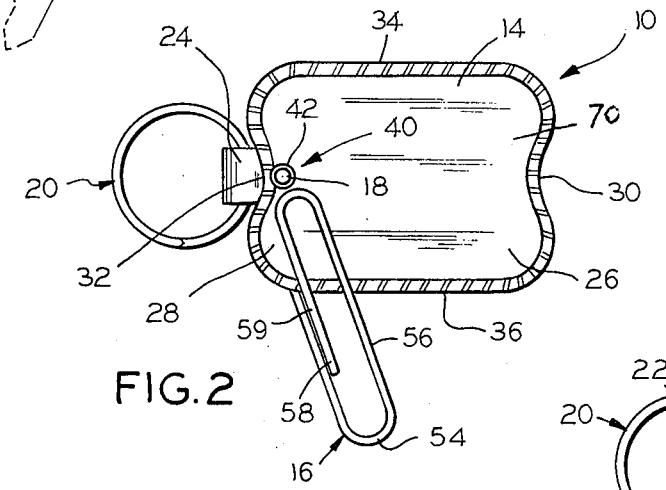
FIG. 2 is a view similar to that of FIG. 1, showing the clip member swung to one of its release positions.

The leg 50 of the clip member 16 is proportioned lengthwise thereof such that the clip member bight portion 54 seats in the indentation 30 of body 14, but accommodates a force fitting of the clipboard lobe portions 60 and 62 through the underside 64 of the clip member bight portion so that the clip member 16 may be moved to either side of the body 14, in the plane thereof, as suggested by the showing of FIG. 2.

The clip member leg 56 is proportioned to extend adjacent to but short of pivot axis 18.

Figure 4:
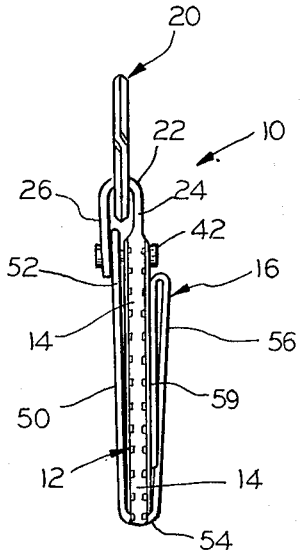
FIG. 4 is a side edge view of the device, taken substantially along line 4—4 of FIG. 1.

The clip member 16 is formed from resiliently flexible wire of the type employed for paperclips, and receives body 14 between the legs 50 and 56, the legs being shaped to bear against the respective side surfaces 70 and 72 of the body 14 in paperclip like style (see FIG. 4).

This permits the application, to either side of the body 14, and under clip legs 50 and 56, of slips of paper or the like that may bear information which the carrier of the device 10 may wish to have for the purpose of running errands, shopping, etc. The leg 50, while having engagement with body 14 adjacent its end 26, lies disposed closely adjacent thereto for easy application of small paper slips to be carried.

Ring 20 is adapted to receive one or more keys, such as the user's automobile and/or house keys, and is of the familiar split annulus type, as shown in FIG. 4.

The body 14 in the form shown is provided on either side of same with knurled edge portion 90 that, in addition to the clamping action that the clip member legs 50 and 56 have on the body 14, insures that the clip member 52 will not be freely pivotally mounted on the body 14, but will be pivotally moveable only where overcoming the static friction established between the body and the clip member.

Further in accordance with the invention, the strap 22 is proportioned and located so as to lodge the ring 20 in substantial interfitting relation with the body indentation 32, between the lobes 96 and 98 at the end 28 of the body 14.

In use, the user may apply his car and/or house keys to the device 10, and specifically to its ring 20. In addition, when the user wishes to have with him reminder notes pertaining to stops to make when going out, or purchases to be made, or the like, this information is written down on appropriately sized slips of paper which can then be inserted under the clip member arm 59 to hold the slips to the clipboard 12. The leg 56 side of the clipboard can take or hold one or more slips of paper, and in addition several slips of paper may be slipped between the clip member leg 50 and the body 14 on the side 72 of the body.

The user keeps the device 10 together with the keys he carries in his pocket, pocketbook or the like, and the presence of the notes clipped to the body 14 is a reminder to the user of the list of things to be noted. Assuming the device 10 is used for the user's car and/or house keys, whenever the device 10 is taken out the user will be reminded by the notes applied to the clipboard 12 that something is to be noted or done.

Figure 3:
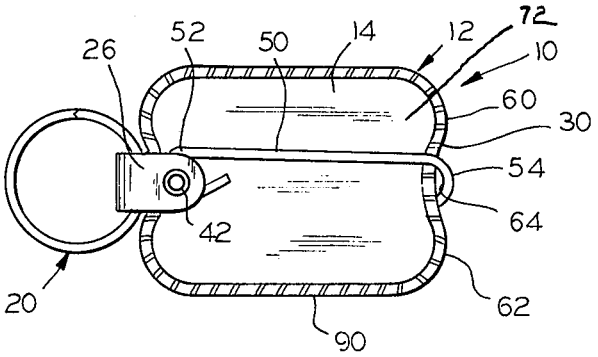
FIG. 3 is a bottom plan view of the device shown in FIG. 1.

The normal operative position of the clip member 16 is shown in FIGS. 1 and 3 wherein the clip member bight portion is lodged in the body indentation 30. However, by swinging the clip member to either side of the body 14, for instance, to the 16 position of FIG. 2, any notes clipped to the clipboard 12 may be readily separated therefrom even though the clip member 16 does not leave clipping engagement with the body 14. The frictional engagement that the clip member legs 50 and 56 have with the body 14, together with the presence of the knurled edgeing 90, and the force fit relation that the body lobes 60 and 62 have with the clip member bight portion 54, insure that the clip member 16 remains in its operative position of FIGS. 1 and 2 even when carried in one's pocket, or when the device 10 experiences shock because of being dropped, etc.

Figure 5:
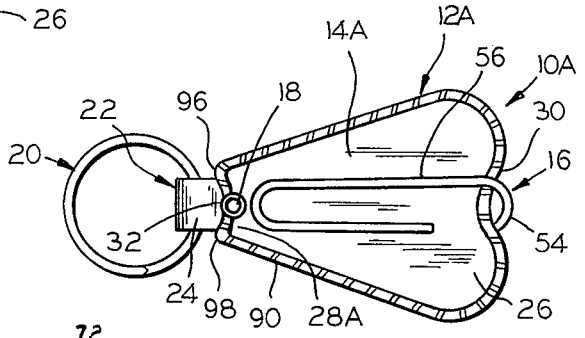
FIG. 5 is a view similar to that of FIG. 1, but showing a variant embodiment.

In the embodiment 10A of FIG. 5, the clipboard 12A is in the form of a body 14A of heart shaped configuration having its end 28A tapered in the direction of indentation 32. Device 10A is otherwise the same as device 10.

It will therefore be seen that the invention provides a handy and uniquely arranged combination key and note holder in the form of a miniaturized clipboard equipped with a swing clip arm that is frictionally held against swinging movement, and a key ring that is disposed in interfitting relation with one end of the miniaturized clipboard. The device 10 is a convenient way of bringing together one's keys and notes that are to be used in doing errands, going shopping, etc. The notes may also be limited to or include an indication of the identity of the lock or locks that the keys carried by the device fit.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A combination key ring and note holder device comprising:

a clipboard comprising a planar body of multi-lateral configuration formed to have its margin define a pair of oppositely extending ends and a pair of oppositely directed side edges extending between same, said body ends being indented inwardly of the body in the plane thereof adjacent the median portion of the respective body ends, said body at one of said ends having a stud secured thereto extending normally thereof and disposed adjacent the indentation thereof;

and a clip therefor comprising:

a clip member having a first leg on one side of said body and pivoted on said stud, a second leg on the other side of said body and free of pivotal engagement with said stud, and a bight portion joining said legs, said legs being formed to resiliently grip said body when said body is disposed therebetween, said first leg between said stud and said bight portion being proportioned lengthwise thereof to, when said body is disposed between said clip member legs, lodge said bight portion in the indentation of said body other end for frictional swinging movement to either side thereof to dispose said clip member to one side of said board, and a key ring anchored to said stud and disposed in interfitting relation with said body one end indentation.

2. The device set forth in claim 1 wherein:

said stud comprises a rivet.

3. The device set forth in claim 1 wherein:

said body defines a knurlled marginal edging along said sides and said other end thereof against which the respective clip member legs engage in being across said body.

4. A combination key ring and note holder device comprising:

a clipboard comprising a planar body of multilateral configuration formed to have its margin define a pair of oppositely extending ends and a pair of oppositely directed side edges extending between same, said body ends being indented inwardly of the body of the plane thereof adjacent the median portion of the respective body ends, said body defining opposed planar side surfaces disposed on either side of same, said body at one of said ends having a stud secured thereto extending normally thereof adjacent the indentation at said one end of said body, and a clip therefor comprising:

a resilient clip member having a first leg on one side of said body and pivoted on said stud, a second leg on the other side of said body and free of pivotal connection with said stud, and a bight portion joining said legs, with said second leg extending toward said one end of said body and being cantilever disposed relative to said bight portion, said legs resilient gripping said body, said first leg between said stud and said bight portion being proportioned lengthwise thereof to lodge said bight portion in the indentation of said body other end for force fit frictional swinging movement to either side thereof to dispose said clip member to one side of said board while retaining gripping engagement with said body, and a key ring anchored to said stud and disposed in interfitting relation with said body one end indentation, whereby when said clip member is disposed in substantial parallelism with said body, and with said body interposed between said legs thereof, said clip member legs bear against the respective body surfaces to hold indicia bearing sheets thereagainst.

5. The device set forth in claim 4 wherein:

said clip member is of one piece filmentous construction.

6. The device set forth in claim 4 wherein:

said clip member second leg extends short of said stud, and is of U-shaped configuration.

7. The device set forth in claim 4 wherein:

a strap passing through said key ring and having its ends made fast to said body anchors the key ring to the stud.

8. A note holder comprising:

a clipboard comprising a planar body of multilateral configuration formed to have its margin define a pair of oppositely extending ends and a pair of oppositely directed side edges extending between same, said body ends being indented inwardly of the body in the plane thereof adjacent the median portion of the respective body ends, said body at one of said ends having a stud secured thereto extending normally thereof, and a clip therefor comprising:

a clip member having a first leg on one side of said body and pivoted on said stud, a second leg on the other side of said body and free of journally engagement with said stud, and a bight portion joining said legs, with said second leg extending toward said one end of said body, said legs resiliently gripping said body, said first leg between said stud and said bight portion being proportioned lengthwise thereof to lodge said bight portion in the indentation of said body other end for force fit frictional swinging movement to either side thereof to dispose said clip member to one side of said board while maintaining gripping engagement with said body, whereby when said clip member is disposed in substantial parallelism with said body side edges, said clip member legs bear against said body on either side thereof to hold indicia bearing sheets thereagainst, and whereby said clip member may be swung to either side of said board for releasing such sheets without freeing said clip member from gripping relation with said body.

* * * * *